United States Patent [19]

Simonutti

[11] Patent Number: 4,835,495

[45] Date of Patent: May 30, 1989

[54] DIODE DEVICE PACKAGING ARRANGEMENT

[75] Inventor: Mario D. Simonutti, Manhattan Beach, Calif.

[73] Assignee: Hughes Aircraft Company, Los Angeles, Calif.

[21] Appl. No.: 179,740

[22] Filed: Apr. 11, 1988

[51] Int. Cl.[4] ..... H01P 5/10

[52] U.S. Cl. ..... 333/26; 333/33; 333/245; 357/81

[58] Field of Search ..... 333/245, 247, 250, 26, 333/33; 357/81

[56] References Cited

U.S. PATENT DOCUMENTS

| | | | |
|---|---|---|---|
| 2,933,705 | 4/1960 | Hapfer | 333/250 |
| 3,210,459 | 10/1965 | Marcinko et al. | 357/81 X |
| 3,448,415 | 6/1969 | DeLoach, Jr. | 333/250 |
| 4,437,077 | 3/1984 | Henry et al. | 333/245 |
| 4,689,583 | 8/1987 | Jerinic et al. | 357/81 X |

*Primary Examiner*—Paul Gensler

*Attorney, Agent, or Firm*—Terje Gudmestad; A. W. Karambelas

[57] ABSTRACT

An arrangement for packaging an active millimeter wave device is provided having an active solid state diode mounted on a cylindrical shaped heat sink pedestal. The cap for the diode is an elongated cylindrical conductor which also serves as a portion of the center coaxial conductor and DC bias pin. A conductive annular ring is also mounted on the pedestal encircling the diode and serves as the outer coaxial conductor for the coaxial transmission line structure. Advantageously the coaxial transmission line, namely the center and outer conductors, can be precisely assembled in relation to the diode for improved impedance characteristic and efficient energy coupling. Furthermore, the elongated cap moves the point of contact with the bias pin to a region of higher RF impedance, reducing RF losses.

7 Claims, 2 Drawing Sheets

DIODE DEVICE PACKAGING ARRANGEMENT

BACKGROUND OF THE INVENTION

1. Field of the Invention

The present invention relates in general to microwave circuits, and more particularly, to the packaging of negative resistance diodes and the circuits employed therewith.

2. Description of Related Art

For more than a decade, there has been substantial interest in development of solid state microwave and millimeter wave diodes which are utilized in a variety of power generation, control and signal processing functions. For example, a negative resistance diode, such as an IMPATT diode, is often employed in an oscillator or an amplifier to convert DC power to radio frequency power. IMPATT diodes are often employed in radio frequency applications where a very high frequency, relatively high conversion efficiency, and solid state reliability are required. IMPATT diodes can be manufactured in great quantities and at low cost. However, a key to ringing every milliwatt of power from such diodes lies in the packaging arrangement for the diode which must provide mechanical support for the diode, input and output circuitry for the diode, and impedance matching between the diode and the RF circuit in which the diode is operated, all of which must be accomplished in the smallest package possible without sacrificing reliability or efficiency.

In a conventional diode packaging arrangement for IMPATT amplifiers, for example, an IMPATT diode chip is mounted on a thermally and electrically conductive cylindrical copper heat sink. A ceramic ring is mounted on the heat sink encircling the diode chip, and gold bonding straps are soldered to the top of the ceramic ring and also to the diode chip, respectively. A thin metal disc is placed over the bonding straps and soldered thereto and serves as the cap to the diode packaging arrangement hermetically sealing the diode. The heat sink, diode chip, ceramic ring and cap form the basic diode package and this assembly is inserted into the rf circuit through a hole in a housing base and followed by a locking screw which holds the cylindrical heat sink in place. A coaxial transmission line structure sits over the diode. This coaxial transmission line structure generally includes several adjacently stacked outer conductors which form a central passageway of varying diameters for an inner conductor disposed therein. The outer and inner conductors provide in combination a multi-section coaxial transmission line for impedance matching. One end of the inner conductor is coaxially disposed on the diode cap and makes electrical contact thereto to provide a DC bias to the IMPATT diode. The cylindrical heat sink forms the ground electrode for the diode.

The multi-section coaxial structure and the IMPATT device package are generally the more difficult elements to align in an IMPATT amplifier or oscillator assembly. Several problems are generally associated with fabricating the above-described arrangement and providing the desired impedance matching between the IMPATT diode chip and the output waveguide. In order to provide optimal impedance match of the diode with the circuit, the IMPATT device package must be coaxially aligned with the inner center conductor and with the outer conductors. This is especially critical for the first closely spaced outer conductor of the multi-section coaxial structure. The width of the annular gap between the outer conductor and center inner conductor may be as little as about one mil. Typically, achieving and maintaining the required concentricity of these parts is difficult to accomplish requiring high cost precision machining and precise placement of the respective parts. The center conductor bias pin must also maintain a close sliding fit within a bias choke which is typically employed to tune the circuit; even small play of the bias pin can destroy the concentricity of the bias pin in the close-fitting coaxial section. Furthermore, environmental conditions such as temperature cycling, vibrations and shock may adversely affect alignment of the individual parts.

Additionally, there may be side-to-side movement when the diode is inserted into the circuit with the tightening of the locking screw. Ultimately, once the diode is assembled on the heat sink and the heat sink inserted into the RF circuit, proper alignment thereof cannot be inspected or easily corrected. Also problematic in the conventional configuration is the electrical contact made between the end of the bias pin and the cap of the diode package. The contact between these two parts is dry, no soldering or welding, resulting in $I^2R$ type RF losses. A circuit configuration which reduces these RF losses would be a great advancement. Additionally, a circuit arrangement is needed which mitigates the possibility of relative movement of the coaxial transmission line section and the diode.

SUMMARY OF THE INVENTION

It is therefore an object of the present invention to provide an integrated circuit packaging arrangement which is easier and simpler to manufacture, and reliable and durable in its operation.

It is a further object of the invention to provide an integrated circuit packaging arrangement wherein the diode device to coaxial transmission line mechanical coupling is vastly simplified relative to those available in the prior art.

It is still a further object of the present invention to provide an integrated circuit packaging arrangement wherein impedance matching efficiency is maximized.

It is therefore a feature of the present invention to have an elongated cylindrical diode cap mounted over the diode and an annular conductive ring concentrically mounted about the diode on a cylindrical heat sink, both of which serve as portions of the coaxial transmission line and thereby simplify alignment for the integrated circuit packaging arrangement.

It is therefore an advantage of the present invention that the diode chip, close-fitting outer coaxial conductor and center conductor can be precisely coaxially assembled together as a subassembly prior to insertion in the overall integrated circuit packaging arrangement.

An integrated circuit packaging arrangement according to the present invention includes a semiconductor diode chip mounted on one end of a cylindrically shaped heat sink. An insulator ring is also mounted on the heat sink encircling the diode chip. An elongated cylindrical diode cap is mounted on the insulator ring making electrical contact to one electrode of the diode chip via a conductive strap. A conductive annular ring, which serves as an outer coaxial transmission line conductor, is mounted on the heat sink about the diode and insulator ring.

Accordingly, the diode device and elongated diode cap, which serves as a portion of the center conductor, can be more accurately and easily coaxially mounted on the cylindrical heat sink, and the annular ring concentrically mounted with respect to these parts. The diode chip and at least a portion of the coaxial transmission line, therefore, can be built up as a subassembly prior to assembly of the rest of the RF circuit arrangement.

DETAILED DESCRIPTION OF THE PREFERRED EMBODIMENT

Figure 1:
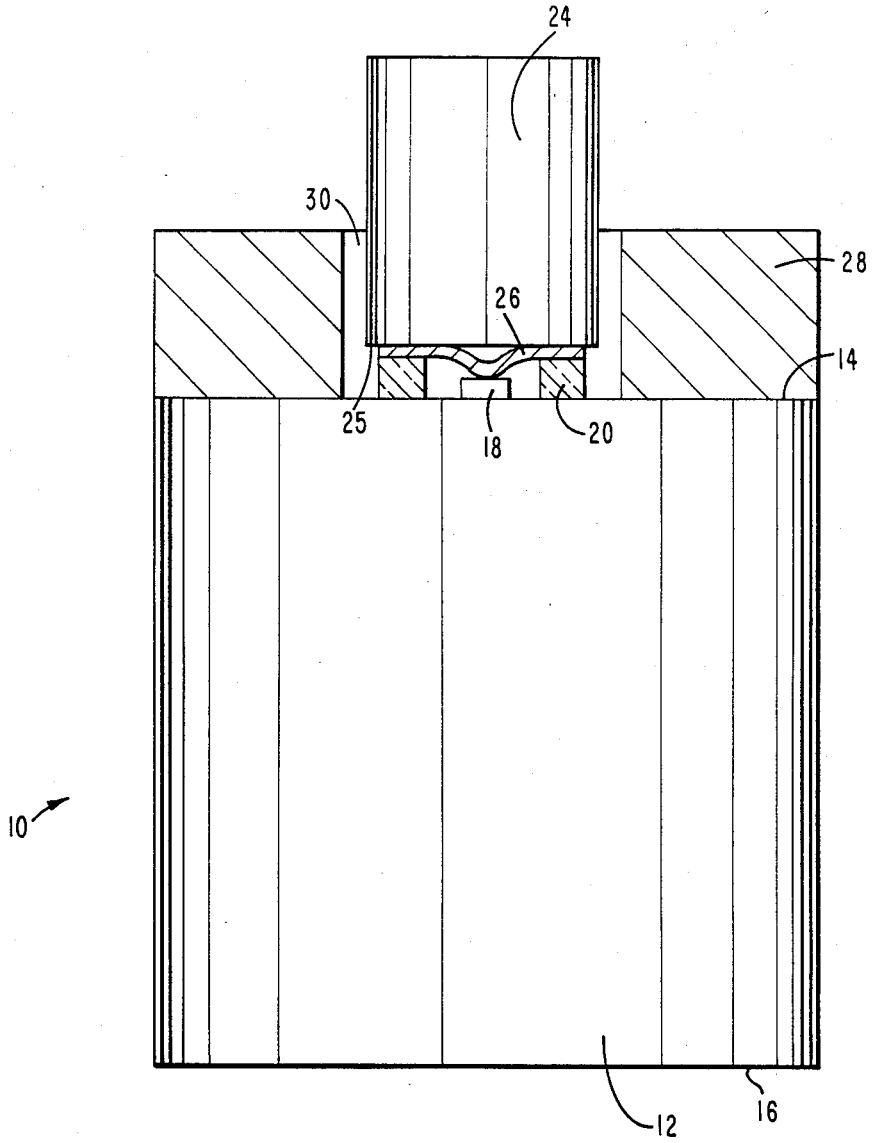
FIG. 1 is a partially broken away side view of a diode packaging subassembly for an integrated circuit packaging arrangement according to the principles of the invention.
Figure 2:
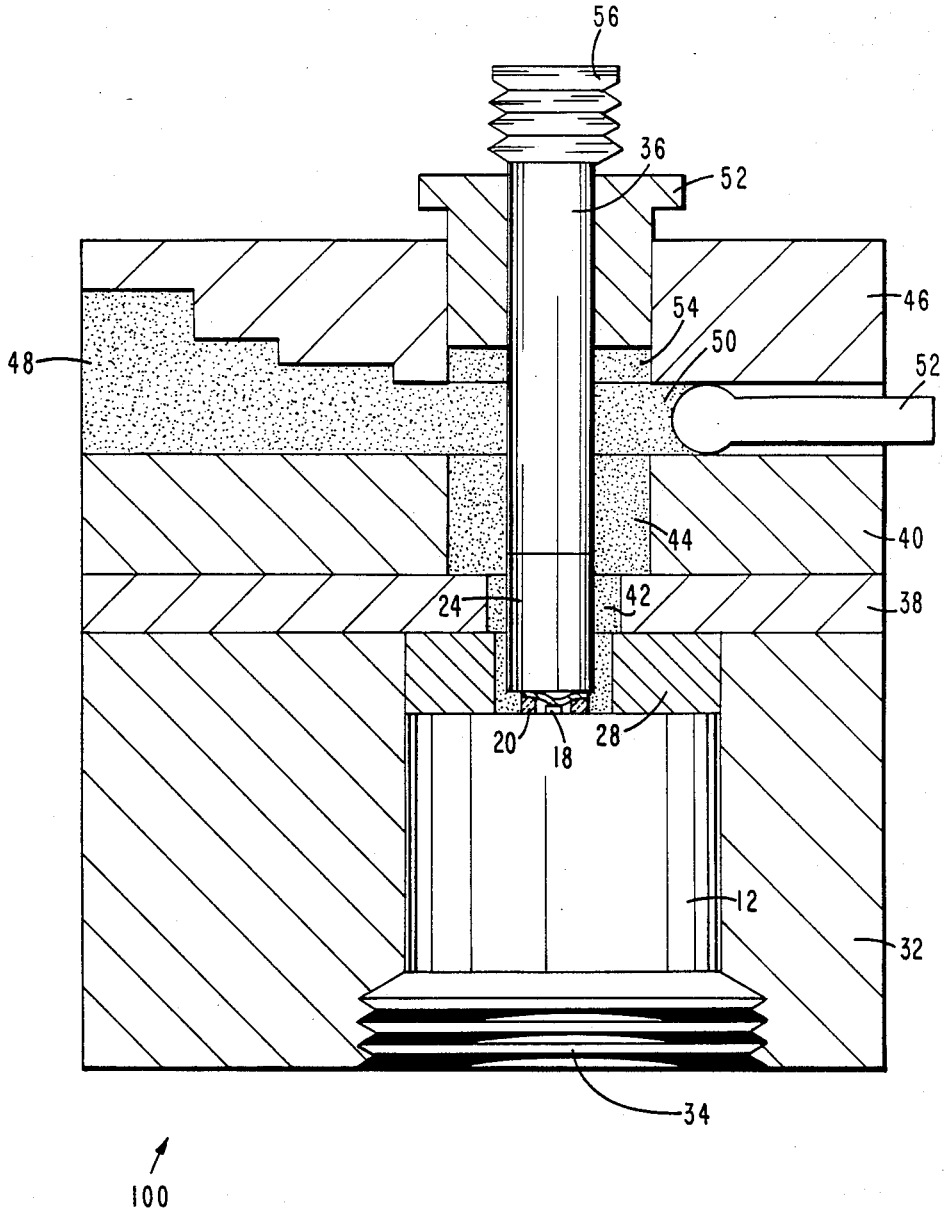
FIG. 2 is a cross-sectional view of an integrated circuit packaging arrangement according to the invention.

Referring now with greater particularity to FIGS. 1 and 2, a packaging arrangement for a two terminal semiconductor device is illustrated. The packaging arrangement 10 includes a heat sink pedestal 12 which is a cylindrically shaped member made of thermally and electrically conductive material having two flat essentially parallel ends 14 and 16. Optionally, a gold plated slab of diamond (not shown) which also serves as a heat sink, may be impressed into one end 14 of the heat sink pedestal 12. A microwave or millimeter wave two-terminal semiconductor device 18, which may be an IMPATT diode chip typically disk-shaped, is mounted axially on one end 14 of the heat sink pedestal 12 by thermocompression bonding, for example. Other millimeter wave diode devices may also be used such as GUNN diodes, PIN diodes, or varactor diodes, for example. The heat sink pedestal 12 thus forms one of the electrodes for the diode chip 18.

An insulator ring 20 which may be made of quartz or ceramic and metalized on its flat surfaces is also bonded to the same end 14 of heat sink pedestal 12 encircling the IMPATT diode chip 18. Gold ribbon 26 is bonded as shown between upper surface of the diode 18 and the upper surface of insulator ring 20. Gold ribbon 26 forms the second one of the electrodes for the diode chip. Elongated diode cap 24 is axially mounted over the diode 18 and heat sink pedestal 12 on the upper surface of gold ribbon 26. A disc-shaped solder preform (not shown) is placed between the insulator ring 20 and elongated cylindrically shaped diode cap 24. The elongated diode cap 24 may be made of gold plated copper, for example. This cap 24 serves not only as a cap for enclosing the diode chip 18 within a sealed region but also as the center conductor of the coaxial transmission line and bias pin for the diode. The assembly is heated to allow the solder perform to melt and bond the cap to the insulator ring. Accordingly, the elongated cylindrically shaped cap conducts the bias current to the IMPATT diode chip through the gold ribbon.

An annular conductive ring 28 is attached to the upper flat surface 14 of heat sink pedestal 12 and positioned concentric to diode chip 18, insulator ring 20, and elongated cap 24. This conductive ring serves as a portion of the outer conductor for the coaxial transmission line. The annular ring 28 may be made of copper, brass, or aluminum and may be bonded to heat sink pedestal 12 by solder, welding, or conductive epoxy, for example.

The components and parts illustrated in FIG. 1 can advantageously be precisely aligned and assembled together rigidly as a subassembly prior to the assembly of the rest of the RF circuit. The annular gap 30 between the annular ring 28 and the elongated cap 24 or center conductor and also the diode chip 18 can therefore desirably be made uniform, maintaining optimum impedance match.

The subassembly 10 illustrated in FIG. 1 is slideably inserted into a hole in housing base 32 illustrated in FIG. 2. Locking screw 34 follows behind the heat sink pedestal 12 to hold subassembly 10 in place so that cap 24 makes good electrical contact with spring loaded coaxial center conductor 36 and also so that annular ring 28 makes good electrical contact with first outer coaxial conductor plate 38. A second coaxial outer conductor plate 40 having a hole therethrough, is mounted adjacent to first conductor plate 38. The elongated cap 24 advantageously makes dry contact to the center conductor 36 in the open region 44 of the second conductor 40. Accordingly, the dry contact is located at a higher impedance point than conventional arrangements, thereby reducing $I^2R$ losses. The holes through both conductors 38 and 40 are coaxially aligned with elongated cap 24. Housing top 46 is mounted on second conductor plate 40. Housing base 32, first and second conductor plates 38 and 40 and housing top 46 are secured together by bolts, for example (not shown). The housing top and conductor plates may be made of aluminum , brass or copper, for example.

Housing top 46 and the second conductor plate 40 form therebetween a waveguide output port 48 and also a channel 50 wherein a sliding backshort 52 can be slideably adjusted to tune the circuit arrangement 100. An insulated sliding choke 52 which may be made of anodized aluminum is slideably inserted into a hole 54 in housing top 46 over the bias pin 36, and can also be slideably adjusted to tune the circuit assembly. A spring or bellows 56 may be used to maintain center conductor 36 in tight relationship with elongated cap 24.

The annular ring 28, first conductor plate 38, and second conductor plate 40 serve as the coaxial line providing an impedance transition from the low RF impedance of the IMPATT device to the higher impedance at the output waveguide, for minimizing insertion losses to the diode active device and maximizing energy coupling between the diode active device and the waveguide. The exact dimensions of the coaxial waveguide parts will, of course, depend on the active device selected and the desired operating frequency of the circuit, among other parameters.

Various modifications may be made to the above-described preferred embodiment without departing from the scope of the invention.

For example, a different number of outer conductor plates may be employed in the coaxial line section of the packaging arrangement. Additionally other tuning structures may be used. Although the invention has been described and shown with reference to particular illustrated embodiments, nevertheless, various changes and modifications obvious to a person skilled in the art to which the invention pertains is deemed to lie within the perview of the invention as set forth in the following claims.

What is claimed is:

1. A millimeter wave integrated circuit packaging arrangement for two-terminal solid state semiconductor devices comprising:

a cylindrically shaped heat sink having essentially parallel ends and a preselected diameter;

a disk-shaped two terminal semiconductor chip having metalized electrodes on both ends, said semiconductor chip axially positioned on one end of the ends of said heat sink one of said metalized electrodes electrically attached thereto;

an insulator ring mounted on said one end of said heat sink encircling said semiconductor chip;

an elongated cylindrically shaped cap made of conductive material mounted on said insulator ring axially with said semiconductor chip;

electrical conductive means interconnected between said semiconductor chip and elongated cap for providing a DC bias connection path to said semiconductor chip;

a conductive annular ring having a radial outer surface of said preselected diameter mounted on said one end of said heat sink concentrically with said semiconductor chip and elongated cap such that an annular gap is formed between said elongated cap and inner radial surface of said annular ring;

outer conductor means positioned on said annular ring and having a passageway therethrough to said annular gap;

a center conductor provided through said passageway in said outer conductor means making electrical contact with said elongated cap; and output waveguide means coupled to said passageway of said conductive body member.

2. A packaging arrangement as defined in claim 1 further comprising means for supplying a DC bias to said center conductor.

3. A packaging arrangement as defined in claim 2 further comprising means for tuning the integrated circuit packaging arrangement.

4. A packaging arrangement as defined in claim 3 further including spring means for holding said center conductor in tight relationship with said elongated cap.

5. A packaging arrangement as defined in claim 2 wherein said semiconductor chip is a millimeter wave IMPATT (Impact Avalanche Transit Time) diode.

6. A packaging arrangement as defined in claim 2 further including bonding means for holding said insulator ring and cylindrically shaped cap in position.

7. A packaging arrangement as defined in claim 1 further comprising means for supplying a pulsed current to said center conductor.

* * * * *